US008100255B2

(12) United States Patent
Smith et al.

(10) Patent No.: US 8,100,255 B2
(45) Date of Patent: Jan. 24, 2012

(54) MUNITION CONTAINER

(75) Inventors: Paul Edward Smith, Cumbria (GB); Raphael Joseph Francis Chetcuti, Cumbria (GB)

(73) Assignee: BAE Systems plc, London (GB)

( * ) Notice: Subject to any disclaimer, the term of this patent is extended or adjusted under 35 U.S.C. 154(b) by 0 days.

(21) Appl. No.: 13/122,191

(22) PCT Filed: Sep. 30, 2009

(86) PCT No.: PCT/GB2009/051276

§ 371 (c)(1),
(2), (4) Date: Apr. 1, 2011

(87) PCT Pub. No.: WO2010/038062

PCT Pub. Date: Apr. 8, 2010

(65) Prior Publication Data

US 2011/0174640 A1 Jul. 21, 2011

(30) Foreign Application Priority Data

Oct. 1, 2008 (EP) ..... 08253204
Oct. 1, 2008 (GB) ..... 0817946.7

(51) Int. Cl.
*F42B 39/00* (2006.01)

(52) U.S. Cl. ..... 206/3

(58) Field of Classification Search ..... 206/3, 317; 102/293, 430–434, 439, 501
See application file for complete search history.

(56) References Cited

U.S. PATENT DOCUMENTS

| | | | | |
|---|---|---|---|---|
| 2,308,480 | A * | 1/1943 | Stanley et al. | 206/3 |
| 2,308,481 | A * | 1/1943 | Stanley | 206/3 |
| 4,558,645 | A | 12/1985 | Boeder et al. | |
| 4,762,222 | A * | 8/1988 | Martin | 206/3 |
| 4,782,758 | A | 11/1988 | Washburn | |
| 4,930,422 | A | 6/1990 | Thouron et al. | |
| 4,940,135 | A * | 7/1990 | Hall | 206/3 |
| 5,779,031 | A * | 7/1998 | Moraine et al. | 206/3 |
| 6,631,801 | B2 * | 10/2003 | Boyd-Moss et al. | 206/204 |
| 7,308,981 | B1 * | 12/2007 | Du Payrat et al. | 206/3 |
| 7,422,102 | B1 | 9/2008 | Lam et al. | |
| 2008/0216640 | A1 | 9/2008 | Brand et al. | |

FOREIGN PATENT DOCUMENTS

DE 34 34 650 A 1 7/1986

(Continued)

OTHER PUBLICATIONS

International Preliminary Report on Patentability and Written Opinion dated Apr. 14, 2011 from PCT/GB2009/051276.
International Search Report dated Nov. 23, 2009.

(Continued)

*Primary Examiner* — Luan K Bui
(74) *Attorney, Agent, or Firm* — Scully, Scott, Murphy & Presser, PC

(57) ABSTRACT

There is disclosed a munition container that stores a munition in a sealed environment such that the seal need not be broken until the munition is ejected from the container into the breech of a gun. The benefits of this are that the munition is protected from the external environment for longer and that the loading operation is accelerated. To facilitate this, the container is provided with a lid & piston which forms part of the seal. The piston may, upon urging by e.g. a ram, slide within the container and outwards into the aligned breech.

15 Claims, 6 Drawing Sheets

FOREIGN PATENT DOCUMENTS

| | | | |
|---|---|---|---|
| EP | 0 849 561 | A2 | 6/1998 |
| GB | 1211325 | | 11/1970 |
| GB | 2 133 864 | A | 8/1984 |
| WO | WO 2006/133470 | A1 | 12/2006 |

OTHER PUBLICATIONS

European Search Report dated Apr. 9, 2009.
UK Search Report dated Jan. 23, 2009.

* cited by examiner

MUNITION CONTAINER

This application is a 371 of PCT GB2009/051276 filed on Sep. 30, 2009.

The following invention relates to a munition container, and in particular a container for a propellant charge.

The environments experienced by a munition as it is transported from a factory to a gun breech may be diverse. The munition may be transported in an unpressurised aircraft hold, or may be stored in a depot without air-conditioning and thus exposed to the local climate, or may be held in proximity to a firing gun.

It is desirable to be able to transport and store munitions in such a way that they are protected against not only external environmental stimuli which might otherwise inadvertently ignite the munition but also external environmental conditions which might cause the munition performance to deteriorate.

A propellant charge, for example, should be protected from stimuli such as mechanical shock and flash (i.e. intense radiating heat caused by a nearby explosion such as the ignition of a round in a breech) as well as being protected from conditions such as humidity. Propellant charges which have no casing, such as the 'L10A2' (in service with the British Army), are particularly sensitive to the stimuli and conditions in external environments.

Given this desire for protection, containers for charges have been developed which provide an airtight compartment for the charge and also provide some form of shock absorbing and heat shielding material.

GB1211325 discloses such a protecting container. In the invention of GB1211325, a container for containing a propellant charge is generally formed from cardboard tubing that absorbs shock and shields from radiation. Additionally, the container has an airtight seal provided predominantly by an encapsulating arrangement of sheet material (e.g. 'hot-sealed aluminium-polyethylene') that protects against environmental moisture. The container is provided with fixed end caps. The container is divided into two sections which are joined by tape.

In order to extract the charge from the container, so as to be able to load the charge into a breech of a gun, the strip of circumferential tape that couples the two sections of the container must be detached. As the tape is detached, the airtight seal is broken. Detaching the tape decouples the sections and once one section of the container has been lifted off the charge and discarded, the charge can be pulled out.

Disadvantageously, the process of opening the container, discarding one section of the container, pulling out the charge and then manoeuvring the charge so that it can be rammed into a breech tends to be a time consuming process.

Worse, once the tape is detached, the said process exposes the charge to the external stimuli and environmental factors, thus increasing the chance of damage to the charge or inadvertent ignition of the charge.

In general, the process of pulling out a propellant charge from a known munition container and then manoeuvring the propellant charge so that it can be rammed into a breech can tend to cause the propellant charge to partially disintegrate and thus form dust particles. The amount of dust generated by one propellant charge may be negligible but in a munition handling system that processes many charges, dust can build up in the handling system.

If the built up dust is inadvertently ignited then the resulting reaction may in turn ignite a nearby munition causing a chain reaction with potentially extreme damage and danger to personnel.

Such handling systems which process many charges are found, for example, on board naval ships. On naval ships, charges are manoeuvred through various levels from a deep magazine to a gun on the ship's deck.

It is an object of the present invention to provide a munition container that mitigates the abovementioned disadvantages of preceding containers, for example by providing a container whereby the munition can be more easily and safely transferred to the breech of a gun.

Accordingly there is provided a container for a munition, the container comprising: a sealable compartment for storing the munition in a sealed environment; wherein the compartment is deformable such that the munition is ejected from the container upon deformation.

Advantageously, by providing the munition in a sealed environment, the munition is protected against the external environment which might harm the munition. The performance of a propellant charge, for example, would deteriorate if exposed to a humid atmosphere for long enough. The container protects against mechanical shock and shields the munition from heat that might otherwise trigger the combustion.

By providing a deformable compartment, such that the munition is ejected as deformation occurs; the ejection can be actuated by ramming devices used in existing munition handling mechanisms. This means that if the container holding the munition can be aligned with the gun breech, then the munition need not be ejected until immediately prior to loading. Delaying the ejection from the sealed compartment until this point tends to minimise the exposure of the charge to the external environment.

Further, the sealed environment acts to protect the external environment from the munition. For example, where the munition is a propellant charge, the highly reactive dust that tends to be generated in the vicinity of the charge is prevented from escaping the bounds of the compartment until ejection. Where the compartment is aligned with a gun barrel prior to ejection, the dust tends to be transferred to the gun barrel and so advantageously prevents the dust from accumulating hazardously in the handling mechanism.

The container can comprise: a generally tubular housing defining a bore; a lid towards the front end of the bore; and a piston located within the bore for sliding along the bore, wherein the compartment is defined between the bore, the lid, and the piston, and wherein the piston can slide along the bore and eject the munition from the container.

Preferably, the lid comprises a recess for accommodating a first portion of a munition and the piston comprises a recess for accommodating a second portion of a munition such that when the munition is accommodated by the lid or the piston, the munition is separated from the tubular housing, thus defining a clearance between the munition and the tubular housing.

Separating the munition from the tubular housing tends to minimise the likelihood of the munition scraping against the wall of the tubular member. This scraping might happen as the munition is ejected. Otherwise, the separation protects against fretting during for example transport. Such contact could damage the munition or inadvertently ignite it; avoiding such contact is therefore beneficial.

Preferably the lid is detachable such that as the compartment deforms, at least one portion of the lid is ejected with the munition.

Thus the separation is maintained by the recesses up until ejection.

A further benefit of the recess is that where the lid is to be transferred to the breech of a gun, the recess ensures that the lid is retained at the munition as the munition is ejected from the container. Thus the lid will be transferred to the breech.

Preferably, the lid comprises weakened regions which promote the breaking up of the lid into a detachable portion and a remaining portion, such that upon ejection of the munition, the remaining portion remains affixed to the container whilst the detachable portion is ejected with the munition.

Advantageously, the provision of such weakened regions means that the lid can be relied upon to break up in a desired way, for example so that the detachable portion features a recess which grips the munition.

Preferably the lid is formed from a combustible material

Preferably the lid is made of a frangible material for breaking up when the munition is fired in the gun.

The frangible or combustible lid can therefore be rammed together with the charge into the breech of the gun wherein it is destroyed on firing of the gun. This means that the lid does not need to be discarded. Instead it is transferred from the container to the breech along with the munition and so a stage in the known munition loading process is avoided. Therefore the loading process with a frangible or combustible lid tends to be quicker than with a lid which must be discarded outside of the breech. This acts to reduce loading times.

A suitable material for forming the lid is unexpanded polystyrene.

Preferably the piston is restrained such that it remains within the bore.

Thus the container remains in one piece and so is apt for being reused.

Also, the retention of the piston within the bore does away with the need for means for recovering the piston from outside of the bore.

Further still, the retention of the piston within the bore tends to quicken the loading process because no time is lost in recovering the piston prior to indexing the munition tray to align the next munition with the breech.

In particular the piston can be restrained by a ridge protruding from the inner surface of the bore.

As an alternative to the ridge, the container may comprise a suitably resilient lanyard for connecting the piston to the tubular member, the resilience being such that the piston is restrained from leaving the bore.

Preferably the piston has a flat base for contacting a ram, advantageously this tends to minimised the size of the piston and so reduces the overall length of the container.

However, if the length of the container is not, for some design consideration, desired to be minimised, then when the container is for use with a handling apparatus comprising a ram, the piston can comprise a cavity for accepting a tip of the ram.

The cavity helps to provide that the ram pushes the piston consistently over the entire stroke of the ram and helps return the piston to the container on retraction of the ram.

Further to this, so that the piston may be retained within the container, it is a further alternative to the ridge that the cavity for accepting a tip of a ram comprises a latching mechanism for temporarily fixing the piston to the tip of the ram such that as the ram retracts, the piston follows.

The container may be used with ramming systems using means other than shaft-type rams to eject the munition. Alternatively, the container may be for use with a form of handling system employing a pressurised fluid, in which case it is preferable that the piston is suitable for actuation by the selective application of a source of high pressure fluid.

Where the piston is intended for actuation by a pressurized fluid, the container preferably comprises a sealed orifice for communicating between the piston and the source of high pressure fluid.

Regardless of the piston actuation apparatus, it is preferred that there is a seal between the piston and the housing, the seal being preserved while the housing stores a munition.

The seal at the rammer end is effected when the piston is in contact with, for example, a sealing member such as an O-ring, set into the bore. The piston is in such contact when the container stores a munition because the presence of the munition pushes the piston to the rammer end of the container and the piston abuts a lip. Beneficially this helps to maintain the compartment as a sealed environment during munition storage.

The piston may comprise a seal at the piston face which abuts a lip of the housing. This seal would be broken if the piston ceases to abut the lip.

Such a seal does not need to be set into the housing, this allows the wall thickness of the housing to be minimised so that, beneficially, the container can hold a charge with a wider diameter.

The piston may comprise a circumferential sealing member attached to the piston such that it seals between the bore to piston interface over the range of possible positions of the piston within the bore.

The sealing member set into the piston enables the compartment to be sealed at the rammer end for the duration of the ejection. This is particularly beneficial when the piston is actuated by fluid pressure because the seal helps to maintain the pressure difference which urges the piston onwards along the bore.

It is also preferred that where the container is sized to accommodate a propellant charge for use in a round of specified calibre, the round comprising a propellant charge and a projectile such that the propellant charge is of a lesser diameter than the projectile, the container is sized to match the dimensions of the projectile to the extent that the container can fit into a projectile handling apparatus intended for handling the projectile.

Advantageously, if a propellant charge is inserted into the container, the container can be manipulated as if it were a projectile, or other form of more robust munition. This allows munitions comprising an exposed propellant charge and a projectile to be manipulated by munition handling systems which are designed for manipulating projectiles. Thus a particular munition handling system may be able to handle more than one muniton system. This is beneficial where it is desirable to harmonise a munition supply across the armed services because existing munition handling systems can be more easily adapted.

An embodiment of the invention will now be described by way of example only and with reference to the accompanying drawings of which:

In the drawings, elements common to all the Figures have been given identical reference numerals for ease of explanation.

Figure 1:
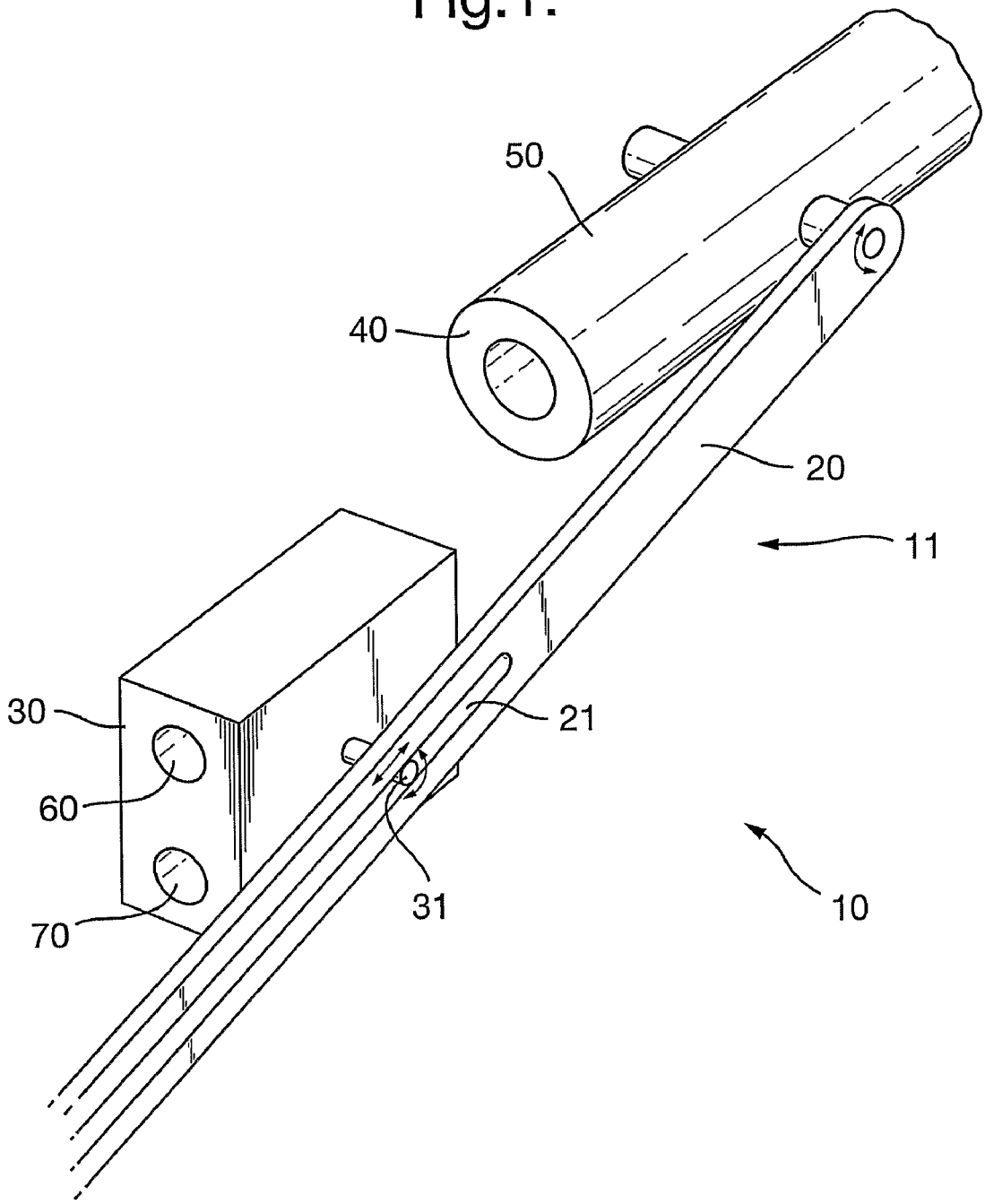
FIG. 1 is a three-dimensional representation of part of a munition handling system for a medium to large calibre gun.

In FIG. 1, part of a munition handling system, shown generally at 10, comprises a guide 11. The guide 11 in turn comprises an arm 20 and a munition tray 30. The guide 11 is moveably positioned adjacent the breech 40 of a medium calibre gun barrel 50.

The arm 20 is pivotally mounted at one end to the gun barrel 50 and is provided with a slot 21 towards its other end. A member 31 extends from the tray 30 and protrudes into the slot 21 so that the tray 30 may slide along the arm 20 and also pivot about the member 31. The arm 20 supports the tray 30 by means of the member 31 protruding into the slot 21.

Figure 3:
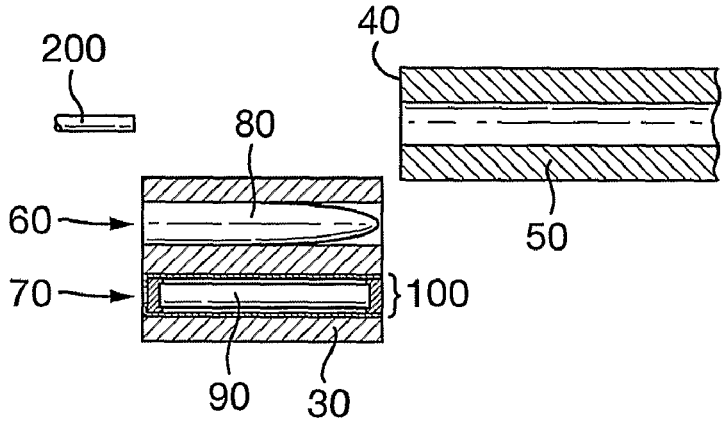
FIG. 3 is a cross-sectioned side elevation of part of the munition handling system shown in FIG. 1, the system is shown in use immediately prior to loading the component parts of a munition into a breech.

The tray 30 defines two chambers: a projectile chamber 60 and a propellant charge container chamber 70. The tray 30 is orientated by the system such that, immediately prior to loading the breech, the projectile chamber 60 is positioned above the charge chamber 70. As shown in FIG. 3 initially chamber 60 contains a projectile 80 of a munition round whilst chamber 70 initially contains a munition container 100 that in turn contains a propellant charge 90 of that round.

Figure 2:
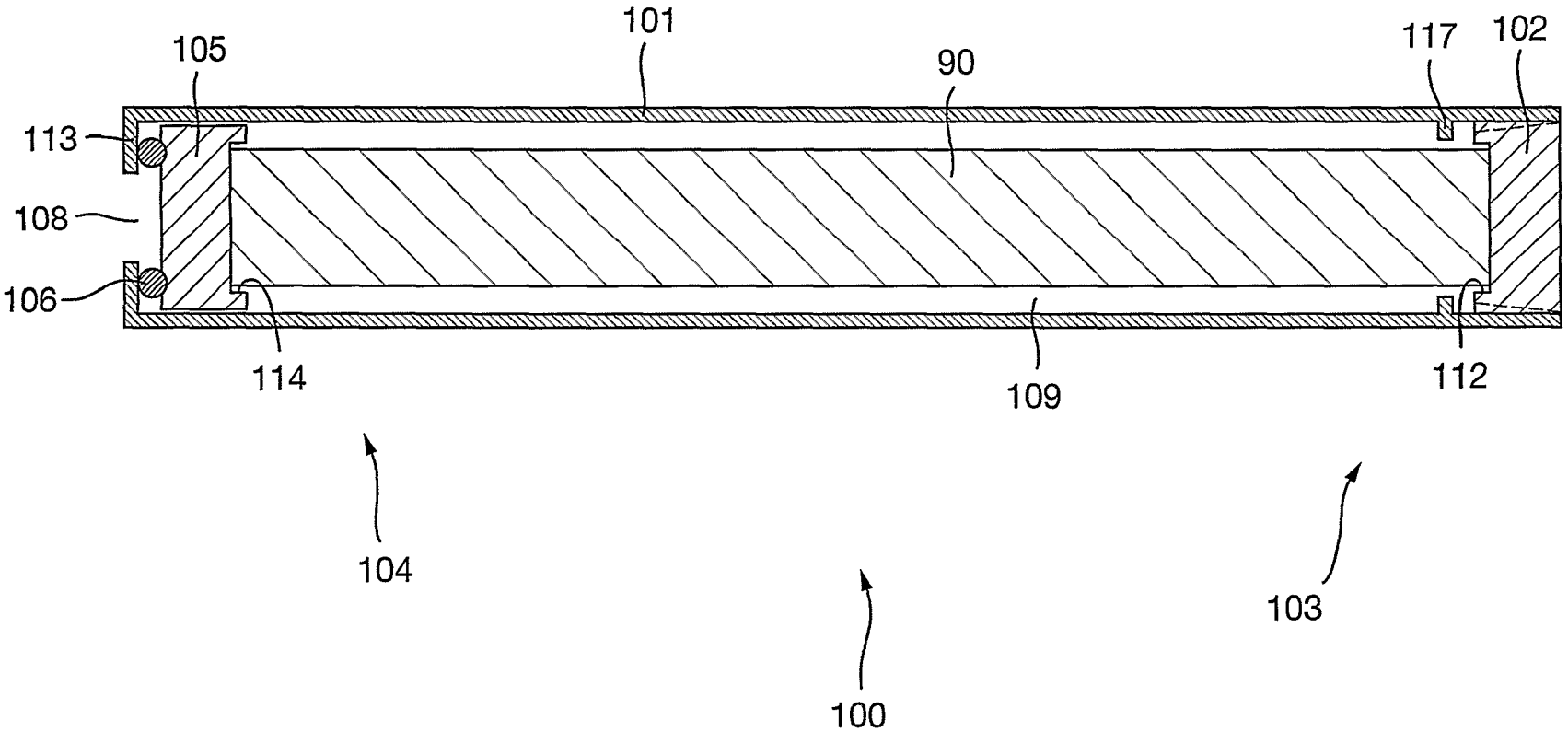
FIG. 2 is a cross-sectioned side elevation view of a munition container according to the invention.

The munition container 100, suitable for storing a charge 90, is shown in more detail in FIG. 2. The container 100 comprises a housing 101 that generally has a hollow cylindrical form but further comprises a lip 113 at its back end. The back end is alternatively referred to as the 'rammer end' 104.

The housing 101 is sealable at its front end with a lid 102 and at the back end by an O-ring 106 between an internal piston 105 and the lip 113. The container thus defines a compartment 109 for holding a charge 90 in a sealed environment. The compartment 109 is sealed such that the leakage of fluids between itself and the external environment is substantially prevented. The housing 101 and the lid 102 have co-operating threaded surfaces (not shown) for attaching the lid 102 and effecting a seal. The end of the container 100 to which the lid 102 is attached will be referred to for reasons which will become apparent, as the 'barrel end' 103.

The piston 105 is slidably located within the inner bore of the housing 101.

Towards the barrel end 103 there is provided a ridge 117 protruding from the housing 101 into the compartment 109. In the event that the piston 105 slides along the bore towards the barrel end 103, the ridge 117 protrudes far enough to abut the piston 105 and thereby prevent it from progressing further. However, the ridge 117 does not protrude far enough to contact the stored charge 90.

Lips 113 define an orifice 108 located at the rammer end of the container 100 which communicates with the interior of the container 100 behind the piston 105.

The piston 105 and the lid 102 are provided with recesses 114 and 112 respectively for accommodating a munition such as the charge 90. The recesses 114, 112 form inner faces of the compartment 109 and act in combination to hold the charge 90 off of the walls of the cylindrical housing 101, thereby defining a clearance that is generally constant about the circumference of the charge 90.

In addition, the recess 112 of the lid 102 has a depth and form such that if the charge 90 proceeds out of the housing 101 and detaches the lid 102 from the bore of the housing 101, the lid 102 will be retained by the front end of the charge 90.

The lid 102 is provided with intentionally weakened regions (shown in broken lines in FIG. 2). Should sufficient pressure be applied to the back of the lid 102, the weakened regions promote the controlled shearing of the lid 102 to form two parts: a first part of the lid 102 (the 'remaining portion') remains attached to the bore of the housing 101, a second part of the lid 102 (the 'detachable portion') is detached from the container 100 altogether. The controlled shearing causes the second part of the lid 102 to be left in a form that can be retained by the front end of the charge 90.

The second part of the lid 102 is therefore the only part of the lid 102 which can be considered to be a detachable lid.

Figure 9:
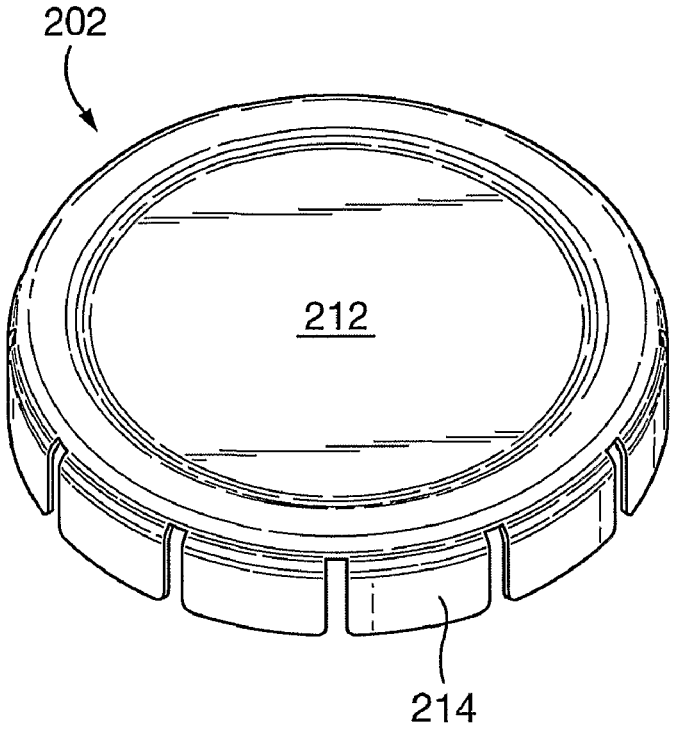
FIG. 9 is a first view of a three-dimensional representation of an alternative form of lid to that shown in FIG. 2.
Figure 10:
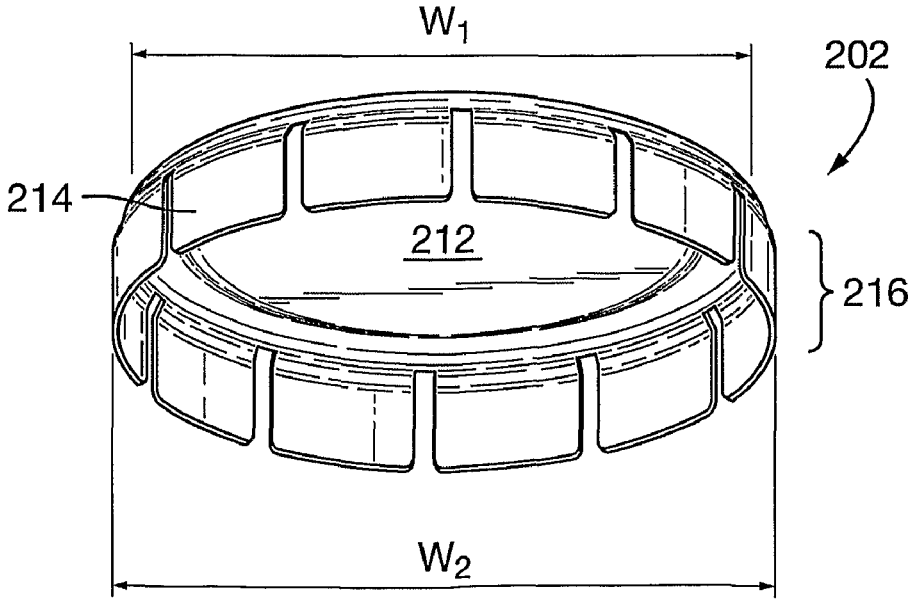
FIG. 10 is a second view of a three-dimensional representation of an alternative form of lid to that shown in FIG. 2.
Figure 11:
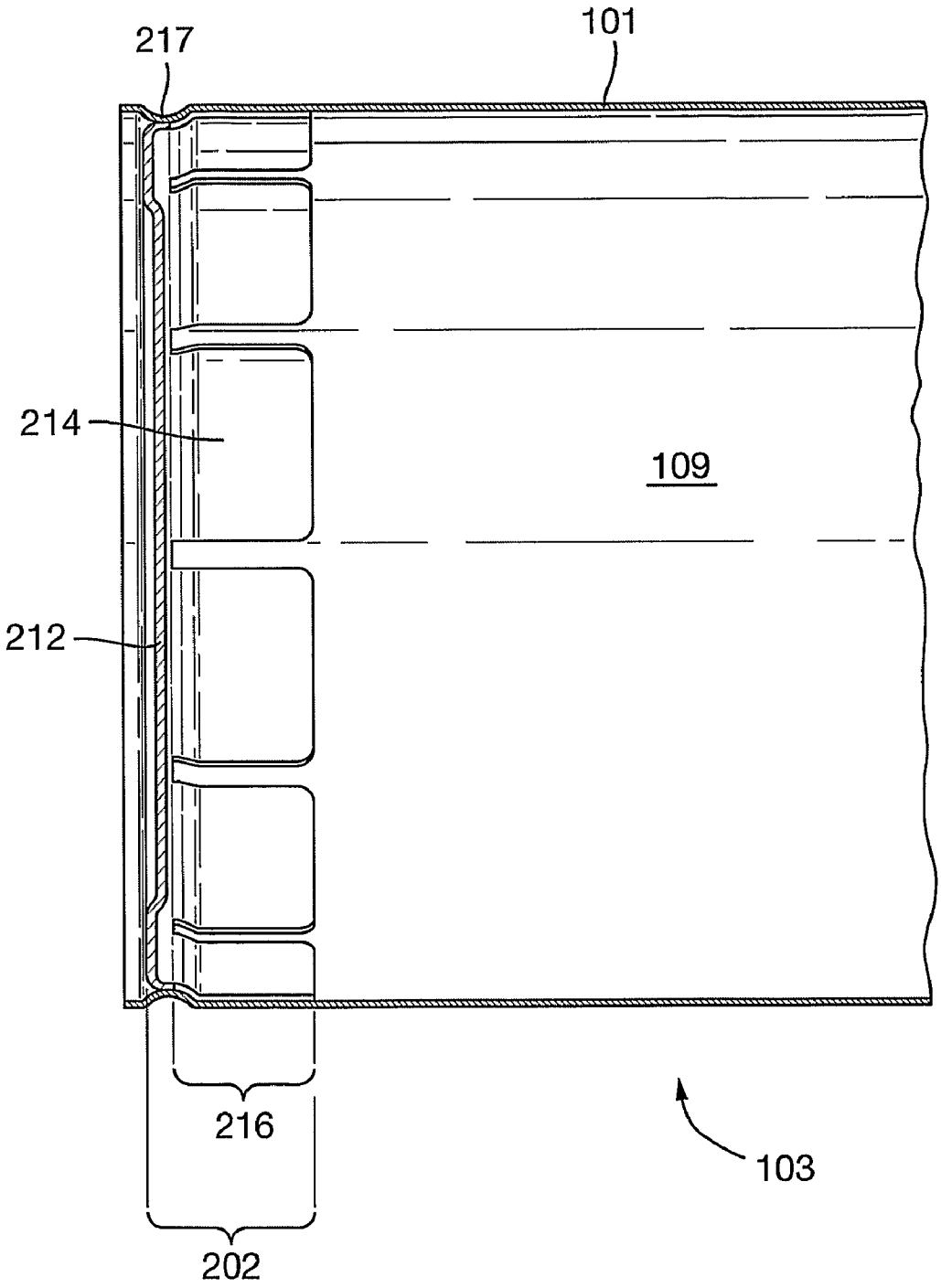
FIG. 11 is a cross-sectioned side elevation of a munition container comprising the lid shown in FIGS. 9 and 10.

In another embodiment of the present invention, as an alternative to the lid 102, a deformable lid 202 as shown in FIGS. 9, 10 and 11 may be used.

The lid 202 has the general form of a cup, insofar as it comprises a plate section 212 and a skirt section 216. However the skirt section 216 is formed by a plurality of individually deformable tabs 214 which extend from the edge of the plate 212. The tabs 214 extend in a generally perpendicular direction but define a skirt section 216 with a slightly greater diameter $w_2$ than the plate section 212 diameter $w_1$. The region in the lid 202 where the diameter increases defines an abutting surface. The tabs are deformable so as to reduce $w_2$.

As shown in FIG. 11, when the lid 202 is placed in the container housing 101, the abutting surface rests on the ridge 217. Thus the lid 202 is held in the housing 100. So as to effect an improved airtight seal, a non-setting compound such as a silicone-based sealant or an oil-based mastic (not shown), can be applied between the lid 202 and container 101 at the abutting surface.

Prior to the insertion of a munition, the container 100 is without a lid 102. The container 100 is loaded from the barrel end 103 with a charge 90 so that the piston 105 is plunged towards and then held at the rammer end 104 abutting the lip 113. The container 100 is then fully sealed by attaching the lid 102. The insertion of the charge 90 and the sealing with the lid 102 occurs, in general, at the munition factory. The munition is then able to be transported from the factory, stored, and later placed in a munition handling system without the seal having to be broken until immediately prior to loading.

As can be seen from FIGS. 3 to 8, the sliding of the piston 105 along the bore is effected by an external ram 200 that has the general form of a shaft and may enter the container 100 via the orifice 108 and continue onwards to engage the piston 105 and push the piston 105 along the bore. Thus, the compartment is deformed. It will be appreciated that if the lid 102 is detachable and the piston 105 is moved longitudinally within the container 100, the contents of the compartment 109 (e.g. the charge 90) will be ejected out of the container 100.

The clearance between the munition and the wall of the housing tends to prevent the munition from scraping the walls as it is ejected.

One application of containers of the type described above is illustrated by FIG. 1 and the sequential loading operation FIGS. 3 through 8. FIGS. 3 to 8 are simplified figures and do not, for example, show the O-ring 106 or the ridge 117.

In FIG. 3 a projectile 80 and a container 100 (containing a propellant charge 90) have been loaded into chambers 60 and 70 respectively in the munition tray 30 in a known way. So that the tray 30 and the chambers 60 and 70 for the munition components can be easily accessed for loading in this known way, the tray 30 is held by the arm 20 in a position so that the chamber 60 and the chamber 70 are offset from the barrel 50.

Figure 4:
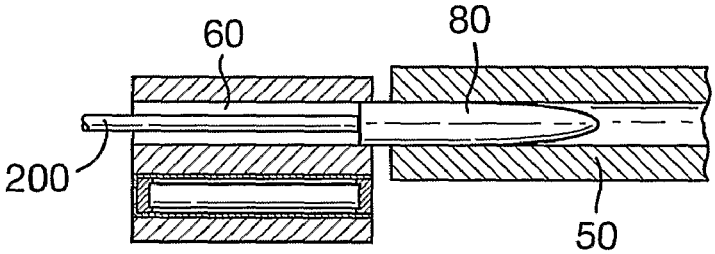
FIG. 4 is a cross-sectioned side elevation of the system shown in FIG. 3, shown after completion of a first indexing step and during the execution of a first step in a loading operation.

Once the munition tray 30 has been loaded with the projectile 80 and the container 100 (containing the propellant charge 90), the arm 20 indexes the loaded tray 30 to the position shown in FIG. 4. Once the tray 30 is loaded and in the position shown in FIG. 4 (i.e. with the projectile chamber 70 aligned with the breech 40 of the barrel 50), the ram 200 may be deployed so as to extend into the projectile chamber 60 and thereby urge the projectile 80 out of the tray 30 and into the gun barrel 50. The ram 200 urges the projectile 80 by contacting the projectile 80 and travelling at a constant speed, thus pushing the projectile 80 into correct engagement with the barrel. In order to avoid shock loads on the ram 200, the stroke of the ram 200 will tend to end before the projectile has assumed its correct position; however the projectile will be carried over the remaining distance e.g. 20-30 mm for a 155 mm round and into its correct position by its own momentum. Thus the projectile 80 can be located in the correct position in the barrel, the correct position being specifically the commencement of the rifling.

Figure 5:
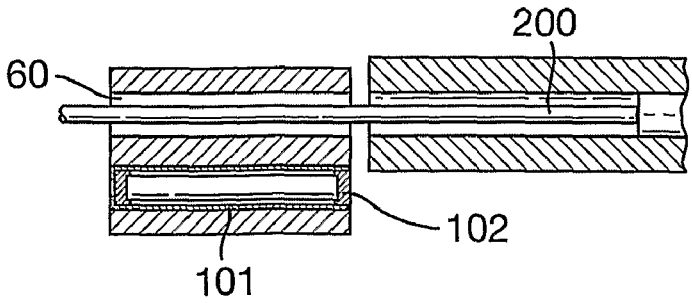
FIG. 5 is a cross-sectioned side elevation of the system shown in FIGS. 3 and 4, shown after the first step in a loading operation but prior to a second indexing step.

Once the projectile 80 is correctly deployed, the ram 200 is retracted out of the tray 30 as shown in FIG. 5.

Figure 6:
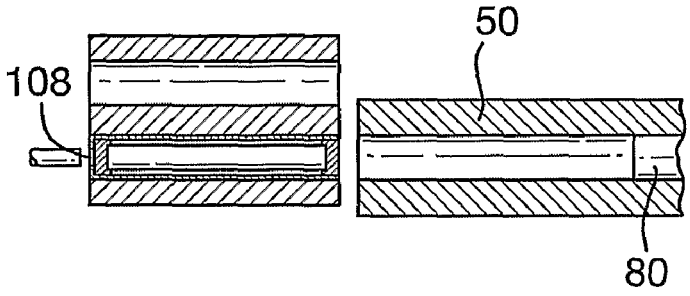
FIG. 6 is cross-sectioned side elevation of the system shown in FIGS. 3, 4, and 5, shown after the second indexing step and prior to the second step in a loading operation.

The tray 30 is then indexed from the position shown in FIG. 4 (i.e. where the projectile chamber 60 is aligned with the gun barrel 50) to the position shown in FIG. 6 (i.e. where the container chamber 70 is aligned with the gun barrel 50). This indexing is once again performed by way of the arm 20 pivoting about the barrel 50.

Figure 7:
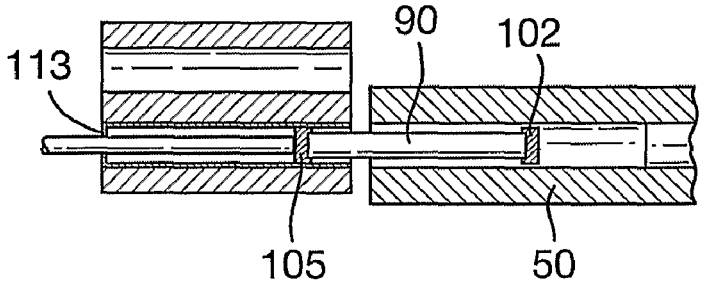
FIG. 7 is a cross-sectioned side elevation of the system shown in FIGS. 3, 4, 5, and 6, shown executing a second step in the loading operation; and, FIG. 8 is a cross-sectioned side elevation of the system shown in FIGS. 3, 4, 5, 6 and 7 on completion of the loading operation prior to firing.

As can be seen from FIG. 7, the propellant charge 90 is transferred to the gun barrel 50 by action of the ram 200. Ram 200 passes into the container chamber 70 and passes through the orifice 108 of the container 100 to abut the flat backside of piston 105. The piston 105 is in contact with the charge 90 which is in contact with the lid 102 and so the action of the ram 200 pressing on the piston 105 displaces not only the piston 105, but also the charge 90 and the lid 102. As these components are displaced along the bore of the housing 101 there are two notable effects.

The first effect is that the seal created by the O-ring 106 between the piston 105 and the lip 113 of the housing 101 is broken as the piston 105 moves away from the lip 113. The second effect is that the lid 102 shears in two at its weakened regions and a portion of the lid 102 (the "detachable portion") becomes detached from the housing 101 (if a deformable lid 202 is used, then the displacement causes tabs 214 to be bent inwards and thus allow lid 202 to pass through the ridge 217). The recess 112 on the inner face of the lid 102 is of a sufficient depth and form that it is retained by the charge 90 so that the majority of the lid 102 remains attached to the end of the charge 90 as the majority of the lid 102 is detached from the housing 101.

As the ram 200 further accelerates the piston 105 and the charge 90 and the lid 102, the lid 102 and the charge 90 are transferred together into the breech 40 of the gun barrel 50. In transferring the charge 90 and lid 102 into the gun barrel 50, the ram 200 accelerates the charge 90 and the lid 102 enough so that they may be transferred wholly into the gun barrel 50 but not so that there is any substantial impact between the projectile base and the leading end of the charge and lid combination.

The piston 105 is also accelerated by the ram 200, but the piston 105 is not ejected from the housing 101 because a protruding ridge 117 abuts the piston. The ram 200 ceases to press on piston 105 in advance of the piston 105 abutting the ridge 117.

Figure 8:
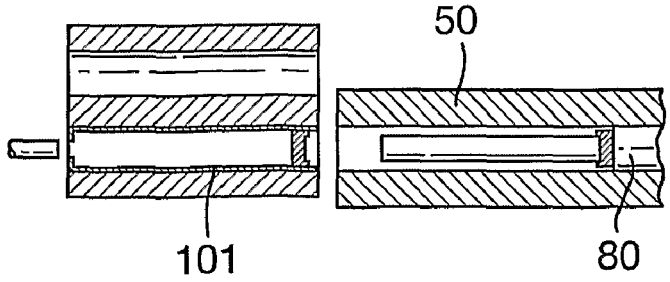

After successfully loading the breech 40, the ram 200 is entirely retracted from the container chamber 70, as shown in FIG. 8. To prepare the tray 30 for another loading operation, the tray 30 may be indexed back to the position shown in FIG. 3 (i.e. with neither the projectile chamber 60 nor container chamber 70 aligned with the gun barrel 50). Once indexed back to this position, the spent container 100 may be removed from the container chamber 70 and either discarded or stored for later reuse. The tray 30 can then be reloaded with another projectile and another container and the gun barrel loading process may start over again.

The lid 102 should be made from a material which tends to completely combust once the round is fired, or at least be frangible so as to exit the gun without leaving significant debris.

Unexpanded polystyrene is a material which is suited for forming the lid because upon firing, a lid made from such polystyrene will tend to disintegrate into smaller particles. Smaller particles are more likely to fully combust or exit the gun.

Further, the interface between a polystyrene lid and the bore of the cylindrical housing effects a seal suitable for the storing of the munition.

The O-ring 106 may be of a conventional type and set partially into the piston. Alternatively, the seal between the piston and the housing may be achieved using an adhesive. The adhesive may be one which sets or may be an adhesive which does not set. Silicone-based sealants or oil-based Mastics would be suitable.

Whichever seal is selected, it may be positioned at the corner of the piston so that it contacts both the wall of the housing 101 and also the lip 113.

For retaining the piston 105 in the container 100 as an alternative to the provision of a ridge 117, a cavity 113 may be provided in the piston 105 that is provided with a latch for forming a temporary attachment to the tip of the ram 200. The attachment holds the piston 105 to the ram 200 as the ram 200 retracts following a loading operation.

As a further alternative to the ridge 117, the piston 105 may be retained within the container 100 by way of a resilient lanyard.

Still further, where a shearable lid 102 is used, the ridge 117 need not be provided if the part of the lid 102 that remains fixed to the housing 101 is fixed (for example by adhesive, or by screwing) firmly enough to stop the piston 105.

A ram having the form of a chain may also be provided as an alternative to the shaft-type ram 200.

As an alternative to moving the piston with a ram of the type heretofore described, the munition handling system may move the piston by way of a high pressure air supply. Other high pressure fluid sources may be suitable.

If the container is for actuation by high pressure fluid, the latched recess in the piston (for engaging the ram) is not suitable for enabling the piston to be retracted. The lanyard is suitable, as is the ridge 117

If the handling system employs such a fluid ram, the container is provided with a connector for importing, for example, high pressure air to the container. The connector is of a conventional type designed for a selectively releasable connection to a high pressure air supply forming part of the handling system. The connector may for example comprise a one-way ball valve. In a container where ejection of the munition is effected by a high pressure air supply, the piston is further provided with a circumferential O-ring seal sufficient to prevent leakage of high pressure air from the rammer end 104 to the barrel end 103 of the container. This piston seal thereby seals at the bore to piston interface over the range of piston positions.

The container 100 should in general be made of a non-flammable, corrosion resistant rigid material.

The housing 101 may be primarily made of steel and formed by a flowforming process as is well known in the art. This allows advantageously thin walls to be achieved without compromising the strength of the container. This tends to reduce the mass of the container and also enables a greater charge diameter to be accommodated.

Preferably, the steel housing is coated with a lacquer, One suitable lacquer is Calguard "Guncoat" which is known in the art. The lacquer improves the container's resistance to corrosion, provides thermal insulation, and provides a low friction coating.

However, depending on design considerations, the container can be made from other materials such as brass or carbon fibre composites.

The invention can be for use in a munition handling apparatus for a 155 mm calibre round comprising a 155 mm projectile and a separate propellant charge such as the 'L10A2'. In such contexts, the projectile has a metal casing and so need not be provided in a sealed compartment such as provided by container 100 described above; any sensitive materials in the projectile are already protected against the environment by the projectile casing. Instead, the projectile may fit directly into the tray 30 of the handling apparatus 10 without being placed in a container. The propellant charge (e.g. the 'L10A2'), however, is provided in a container 100.

Where the propellant charge is for use in a 155 mm weapon system, the container 100 is sized so that it has an equivalent external form to an associated 155 mm projectile. The L10A2 charge has a smaller diameter than its associated 155 mm projectile. When the housing is formed by a flow forming process, the thickness of the wall of the cylindrical housing 101 is in the region of 1.1 mm and the clearance between charge and bore is in the region of 2.85 mm. This sizing of the container 100 allows the charge (when held in the container) to be handled by the apparatus as if it were a projectile. Beneficially, this means that a single handling system can be used to manipulate the projectile and the charge. It also makes it easier to modify an existing projectile handling apparatus so that it may handle either projectiles or charges.

Many modifications and variations on the above examples will now suggest themselves to ones skilled in the art. In particular, the invention may be applied to any calibre of munition. Where the container is for munition calibres other than 155 mm, the dimensions mentioned above such as clearance are scaled appropriately.

The invention claimed is:

1. A container for a munition, the container comprising:

a sealable compartment for storing the munition in a sealed environment, the compartment being formed by a generally tubular member defining a bore which is sealed by a lid towards a front end of the bore and a piston located within the bore for deforming the compartment by sliding movement along the bore to eject the munition from the container; wherein the lid is configured such that as the compartment deforms, at least one detachable portion of the lid is ejected with the munition.

2. A container according to claim 1, wherein:

the lid comprises a recess for accommodating a first end portion of a munition, and the piston comprises a recess for accommodating a second end portion of a munition, such that when the munition is accommodated by the lid or the piston, the munition is separated from the tubular member, thus defining a clearance between the munition and the tubular member.

3. A container according to claim 1 wherein the lid comprises weakened regions which promote the detachment of said at least one detachable portion of the lid from a remaining portion of the lid, such that upon ejection of the munition, the remaining portion remains affixed to the container whilst the detachable portion is ejected with the munition.

4. A container according to claim 1 wherein the lid is formed from a combustible material selected to combust when the munition is fired from a gun.

5. A container according to claim 1 wherein the lid is made of a frangible material selected to break up when the munition is fired in the gun.

6. A container according to claim 1 comprising a retainer for retaining the piston in the bore when the munition is ejected.

7. A container according to claim 6 wherein the retainer comprises a ridge protruding inwardly from an inner surface of the bore.

8. A container according to claim 6 wherein the retainer comprises a resilient lanyard for connecting the piston to the tubular member, the resilient lanyard being sufficiently resilient to restrain the piston from leaving the bore when the munition is ejected.

9. A container according to claim 1 wherein the piston has a flat base for contacting the tip of a ram.

10. A container according to claim 1 wherein the piston is fitted within the bore to allow actuation by the application of a source of high pressure fluid.

11. A container as claimed in claim 10 wherein the container comprises:

a sealed orifice for communicating between the piston and the source of high pressure fluid.

12. A container as claimed in claim 1 comprising:

a seal located between the piston and the tubular member configured to seal the bore when the munition is stored and to open when the munition is ejected.

13. A container as claimed in claim 1 wherein the piston further comprises:

a circumferential sealing member attached to the piston such that it seals between the bore to piston interface over the range of possible positions of the piston within the bore.

14. A container according to claim 1 sized to accommodate a propellant charge for use in a round of specified calibre, the round comprising a propellant charge and a projectile such that the propellant charge is of a lesser diameter than the projectile, wherein:

the container is sized to match the dimensions of the projectile to the extent that the container can fit into a projectile handling apparatus intended for handling the projectile.

15. A container according to claim 1 wherein the housing is formed of steel and the walls of the housing are between 2.0 mm and 0.4 mm thick.

* * * * *